United States Patent [19]

Showering

[11] Patent Number: 4,773,676

[45] Date of Patent: Sep. 27, 1988

[54] CONTINUOUS STATIONERY

[76] Inventor: Francis K. Showering, 5 Clareville Grove, London, England, SW7 5AU

[21] Appl. No.: 937,971

[22] Filed: Dec. 4, 1986

[30] Foreign Application Priority Data

Dec. 11, 1985 [GB] United Kingdom ..... 8530497

[51] Int. Cl.[4] ..... B42D 1/12; B42D 15/00; B41L 1/32; B41L 1/14

[52] U.S. Cl. ..... 281/2; 281/15 R; 270/39; 270/41

[58] Field of Search ..... 281/2, 15 R; 283/16; 270/32, 39, 40, 41, 42, 43; 493/355, 356, 360, 363, 377, 378, 396

[56] References Cited

U.S. PATENT DOCUMENTS

| | | | |
|---|---|---|---|
| 3,592,712 | 7/1971 | Greason | 270/39 |
| 4,285,531 | 8/1981 | Balsamo | 281/2 |
| 4,516,761 | 5/1985 | Ricciardi | 270/41 |
| 4,551,374 | 11/1985 | Holmberg | 281/2 |
| 4,560,600 | 12/1985 | Yellin et al. | 281/2 |
| 4,573,670 | 3/1986 | Felix | 270/39 |
| 4,575,121 | 3/1986 | Conti | 281/2 |
| 4,601,692 | 7/1986 | Rausing et al. | 281/2 |

FOREIGN PATENT DOCUMENTS

| | | |
|---|---|---|
| 0129950 | 1/1985 | European Pat. Off. . |
| 716154 | 9/1954 | United Kingdom . |
| 1044814 | 10/1966 | United Kingdom . |
| 1337902 | 11/1973 | United Kingdom . |

*Primary Examiner*—E. R. Kazenske
*Assistant Examiner*—Paul M. Heyrana, Sr.
*Attorney, Agent, or Firm*—Silverman, Cass, Singer & Winburn, Ltd.

[57] ABSTRACT

Continuous stationery capable of being easily divided up into individually separated sheets. The sheets 10 are joined at their transverse edges, 13, 14, 15 etc. Additional score lines 21 and 22 run transversely across the sheet and extend beyond longitudinal score lines 16 and 18 into the vertical margins. A row 27 of punched holes is formed adjacent score line 16. Information is printed on the area 25. To assemble the information, the vertical marginal portions are removed along score lines 16 and 18. The horizontal marginal portions are then removed by tearing along score lines 21 and 22, leaving a pile of printed separated sheets which can then be put in a loose-leaf binder to form e.g. an address book.

6 Claims, 2 Drawing Sheets

CONTINUOUS STATIONERY

This invention relates to continuous stationery and is particularly concerned with a method of easily dividing up continuous stationery into individually separated sheets.

Continuous stationery is used for printing on by computer systems, word processing systems, accounting machines etc. It is usually provided in the form of a continuous length of paper which is folded in alternate directions, in concertina fashion, the fold lines sometimes being scored or otherwise treated for subsequent separation of the sheets.

For certain applications it is desirable to be able to quickly separate out from continuous stationery the individual sheets which contain desirable information.

In accordance with the invention there is continuous stationery of a kind in which a continuous sheet of paper is folded in concertina fashion so that the fold lines are provided at alternate opposite edges of the ultimate size of the folded sheets, and in which, inset from each longitudinal edge of each sheet, a score line is provided extending the length of the sheet, additional score lines being provided inset from and parallel to the folded edges of the sheets and being arranged so that they extend at least as far as the first mentioned score lines so that the marginal portions of both the longitudinal edges of the sheets and the lateral edges of the sheets may be removed subsequently so as to leave a sequential pile of individual sheets.

There may be additionally one or more score lines adjacent to the centre of the sheets and extending longitudinally of the sheets so that the portion of the sheets left after removal of the margins as described above may be subdivided into two or more portions.

Rows of punched holes may be arranged in each sheet adjacent appropriate score lines so that when the sheets are in their final form the punched holes will serve to attach the sheets to a loose-leaf binder or similar system.

In a preferred form of the invention each sheet has score lines which divide it up into two equal portions within the score lines, each portion having its own row of punched holes so that the portions may be put together to form a loose-leaf booklet or the like.

By use of the system a computer can be arranged to print, on the portion of the sheet within the score lines, an alphabetical list of addresses for instance or a computerized diary. The sheets can then be separated by the removal of the four margins as described above and the individual sheets used in a loose-leaf binder or suitable indexed system.

In the accompanying drawings:

FIG. 3 shows another form of the invention, each sheet having score lines which divide the sheet into two equal portions and each portion having its own row of punched holes so that both portions may be printed on and subsequently separated and put together to form a loose-leaf booklet or the like.

Figure 2:
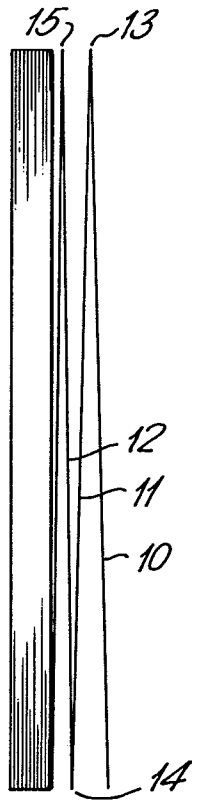
Figure 1:
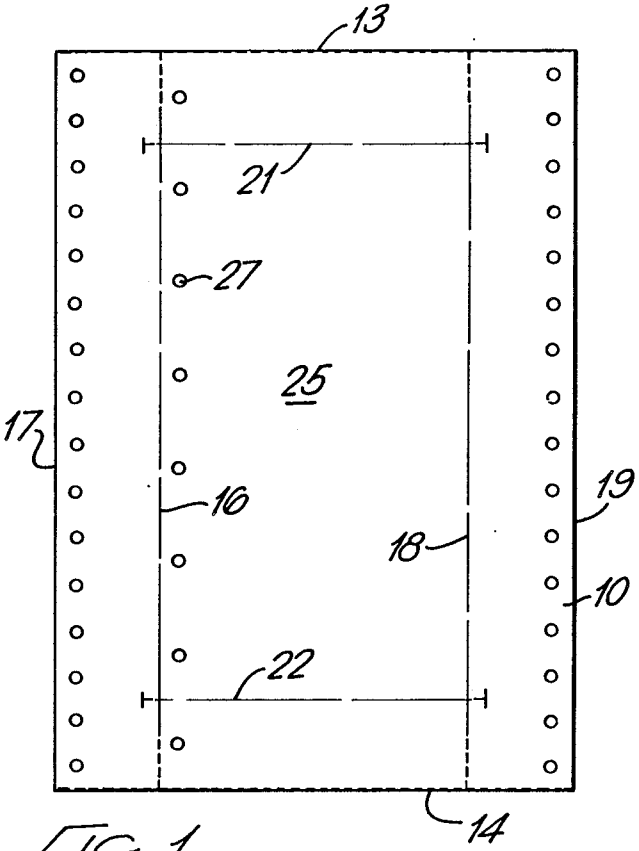
FIG. 1 is a plan view of one sheet of continuous stationery being the top sheet of a pile of sheets of continuous stationery shown in side elevation in FIG. 2.

The continuous stationery shown in FIG. 1 consists of a number of sheets such as sheet 10 arranged in a pile as illustrated in FIG. 2, with sheets 10, 11, 12 etc. in sequence. It will be noted that the sheets are joined at their transverse edges, 13, 14, 15 etc.

Each sheet has a score line 16 adjacent the left hand longitudinal edge 17 and a score line 18 adjacent the right hand longitudinal edge 19.

There are additional score lines 21 and 22 running transversely across the sheet. As shown they extend beyond score lines 16 and 18 into the vertical margins but for production reasons and to encourage the correct separation order they extend to just beyond the vertical perforations. Adjacent score line 16 is formed a row 27 of punched holes.

Information which is required to be put into the form of a loose-leaf binder or other collected system is printed on the area 25 on the continuous stationery. To assemble the information the vertical marginal portions are removed along score lines 16 and 18. It will be noted that the paper is still held in concertina fashion in a pile. The horizontal marginal portions are then removed by tearing along score lines 21 and 22 leaving a pile of printed separated sheets which can then be put into a loose-leaf binder or other system.

Figure 3:
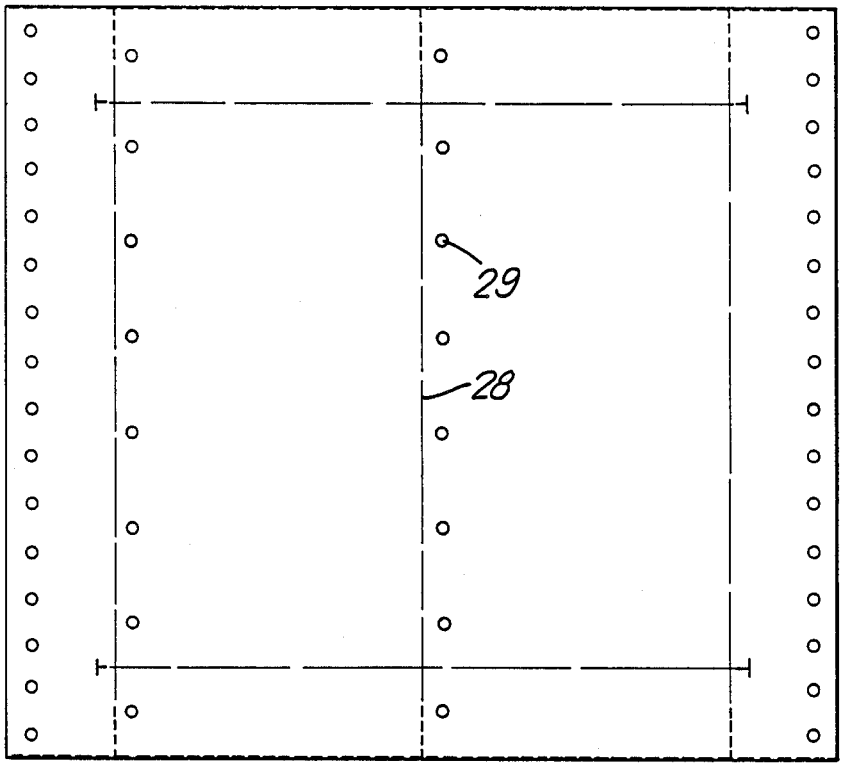

FIG. 3 shows a modified form of the invention in which there is an additional score line 28 and an additional row of punched holes 29 so that the sheets may be divided into two separate piles of paper.

A computer can be programmed to print the information so that the sheets when separated using the above method are in their ultimate form, so that the pile of separated paper can be placed directly into a binding system, i.e. alternate pages are printed inverted (last line first, first line last).

The principal advantage of this invention is that it enables information printed on multiple sheets of continuous stationery by a computer or word processor or other printing system to be separated into individual sheets quickly and easily by the removal of just four marginal portions without the need for careful individual separation of the sheets.

I claim:

1. Continuous stationery of a kind in which a continuous sheet of paper is folded in concertina fashion so that the fold lines are provided at alternate opposite edges of the ultimate size of the folded sheets, and in which, inset from each longitudinal edge of each sheet, a score line is provided extending the length of the sheet, additional score lines being provided inset equidistant from and parallel to the folded edges of the sheets and being arranged so that they extend at least as far as the first mentioned score lines so that the marginal portions of both the longitudinal edges of the sheets and the lateral edges of the sheets may be removed subsequently while folded together in bulk so as to leave a sequential pile of individual sheets.

2. Continuous stationery according to claim 1 and in which there are additionally, one or more score lines adjacent to the centre of the sheets and extending longitudinally of the sheets so that the portion of the sheets left after removal of the margins may be subdivided into two or more portions.

3. Continuous stationery according to claim 1 in which rows of punched holes are arranged in each sheet adjacent appropriate score lines so that when the sheets are in their final form the punched holes will serve to attach the sheets to a loose-leaf binder or similar system.

4. Continuous stationery according to claim 1 and in which each sheet has score lines which divide it up into two equal portions within the score lines, each portion may be put together to form a loose-leaf booklet or binding system.

5. Use of continuous stationery according to claim 1 in which a computer is arranged to print, on the portion of each sheet within the score lines.

6. Continuous stationery according to claim 1 wherein said additional score lines are parallel along their entire length to said folded edges of said sheet.

* * * * *